US005806351A

United States Patent [19]

Learnahan

[11] Patent Number: 5,806,351

[45] Date of Patent: Sep. 15, 1998

[54] LOCK WELL FOR VEHICLE DOOR

[76] Inventor: Harold Learnahan, 4206 W. Melrose St., Chicago, Ill. 60641

[21] Appl. No.: 539,710

[22] Filed: Oct. 5, 1995

Related U.S. Application Data

[63] Continuation of Ser. No. 145,565, Nov. 4, 1993, abandoned.

[51] Int. Cl.[6] ..... E05B 67/38

[52] U.S. Cl. ..... 70/56; 70/2; 70/423; 70/455; 70/DIG. 65; 292/148

[58] Field of Search ..... 70/2, 54–56, 417, 70/DIG. 65, 455, 423–428, DIG. 38, DIG. 47, DIG. 43, DIG. 56; 292/148, 284

[56] References Cited

U.S. PATENT DOCUMENTS

| | | | |
|---|---|---|---|
| 1,927,948 | 9/1933 | Nunn | 292/148 X |
| 2,856,220 | 10/1958 | Easley | 292/148 |
| 2,912,271 | 11/1959 | Schaefer | 292/148 X |
| 2,987,358 | 6/1961 | Roberts | 292/148 X |
| 3,559,429 | 2/1971 | Hermann | 70/56 X |
| 3,572,062 | 3/1971 | Beebe | 70/1.5 |
| 3,655,229 | 4/1972 | Tumbiolo | 292/148 |
| 3,759,557 | 9/1973 | Athas | 70/54 X |
| 3,852,981 | 12/1974 | Koning | 70/2 |
| 3,884,057 | 5/1975 | Maurer | 70/54 X |
| 4,290,281 | 9/1981 | Knaack et al. | 70/63 X |
| 4,322,102 | 3/1982 | Lindblom | 292/148 X |
| 4,581,907 | 4/1986 | Eberly | 70/54 |
| 4,676,534 | 6/1987 | Hix, Jr. | 292/205 |
| 4,742,701 | 5/1988 | Scavetto | 70/121 |
| 4,877,275 | 10/1989 | DeForrest, Sr. | 292/148 |
| 4,895,007 | 1/1990 | Eberly | 70/54 |
| 5,092,143 | 3/1992 | Rumbles | 70/56 |
| 5,174,135 | 12/1992 | Loughlin | 70/56 X |

OTHER PUBLICATIONS

Installing the Vivo TS 4000 Lock and Hasp Set, Locksmith Ledger, Nov. 1989, pp. 22 and 24.

*Primary Examiner*—Lloyd A. Gall
*Attorney, Agent, or Firm*—Patula & Associates

[57] ABSTRACT

A locking mechanism comprising a lock housing mounted in a hinged unit or the like and a bolt mounted to a fixture. The housing has a hole therein for receiving an end of the bolt. The bolt end includes a locking aperture for receiving a shackle of a padlock. The padlock locks around the locking aperture and is then positioned inside housing 20 to protect the padlock from being cut or broken. The novel design of the locking aperture allows the padlock to be selectively positioned in one of three positions, and thus fit within a narrow cavity not much large than the size of the padlock.

30 Claims, 3 Drawing Sheets

LOCK WELL FOR VEHICLE DOOR

This is a continuation of U.S. patent application Ser. No. 08/145,565 filed Nov. 4, 1993, now abandoned.

The present invention relates generally to a protective well for a lock, and more particularly a protective well for a padlock, and specifically, a locking mechanism for vehicle doors having double doors such as on a van or a truck.

BACKGROUND OF THE INVENTION

It is a sad fact, especially in today's society with a soaring crime rate, that their exists a need to lock various enclosures or items to prevent others from entering the enclosures or in general to keep an item protected and safe from theft, damage, etc. In the past, the typical and perhaps most convenient way of doing so is with the use of a padlock. However, the use of a padlock to prevent something from being opened has proven somewhat ineffective in that padlocks usually are completely accessible and therefore are relatively easy to cut or pry open or to pick the lock. Further, if the padlock is being used outdoors, it is subject to damage from the weather.

Therefore, there exists a need to protect a padlock from being tampered with, thereby dramatically increasing its effectiveness, while at the same time allowing the padlock to be readily accessible and easily openable by an owner or authorized user.

There have been several attempts to protect padlocks from being tampered with; however, these attempts are either inefficient, ineffective, extremely complicated, and/or extremely limit any type of access to the padlock, even by the owner.

One such attempt to protect a padlock is disclosed in U.S. Pat. No. 5,092,143 issued to Rumbles. Rumbles discloses a lockable enclosure having a tamper-proof locking assembly having a guard housing made large enough for insertion of a human hand. However, Rumbles' locking assembly is difficult and time consuming to lock and unlock due to the fact that the locking assembly cannot be seen. Further, the assembly is complicated since it has several movable parts and levers which must be manipulated to open an enclosure once the padlock has been removed.

U.S. Pat. No. 4,877,275 issued to DeForrest Sr. discloses a protected sliding bolt locking structure in which a padlock is used to prevent a locking bolt from being slid to an opened position. The locking structure of DeForrest. Sr. remains completely exposed to and unprotected from the weather. Further, the keyhole of the padlock is easily accessible to an unauthorized person attempting to pick the lock. Additionally, the locking bolt itself is not protected in any manner and could easily be cut or broken, thereby rendering the padlock useless.

U.S. Pat. No. 4,676,534 issued to Hix. Jr. discloses a lock assembly disposed in a housing plate in which a padlock is placed in a first aperture to lock the assembly or placed in a second aperture to act as a handle to turn the lock. The lock assembly of Hix. Jr. does not protect the padlock in any way and the padlock, therefore, remains accessible and can be easily cut open.

U.S. Pat. No. 3,852,981 issued to Koning discloses a padlock locking device that allows a padlock locking a hinged unit to be opened from either side of the hinged unit. The locking device of Koning does not protect the padlock in any way and the padlock, therefore remains completely accessible and can be easily cut open.

The above prior art pertains generally to locking assemblies using padlocks. None of the above prior art locking assemblies is suitably adaptable to be applied as a locking mechanism for vehicle doors having hinged double doors such as on vans or trucks. The rear doors on a van, for example, typically consist of two hinged double doors. These doors swing open and away from each other about their hinges on their respective sides of the van. The doors are aligned such that one door must be opened (at least partially) before the other door can. This is due in part to an existing door bolt mounted in one door, to which a locking mechanism in the other door locks around. When the locking mechanism is unlocked, the door with the locking mechanism is free to swing open. Thereafter, the door with the door bolt is free to swing open.

However, the existing locking mechanism for such doors on a van or truck can be readily circumvented, either by breaking the relatively short door bolt mounted to one door, or by breaking the locking mechanism mounted in the other door, through a technique referred to as "punching in" the lock. Accordingly, there is a need to provide an improved locking assembly for vehicles.

U.S. Pat. Nos. 4,895,007 and 4,581,907 issued to Eberly disclose security devices for padlocks used in conjunction with locking mechanisms for truck doors. However, Eberly uses the padlocks to lock external locking mechanisms on truck doors, for example an external movable latch. Further, Eberly's padlocks are exposed to the weather and the keyhole is exposed at all times, making the padlocks readily pickable. Additionally, the locking devices are relatively complicated and time consuming to use. Also, while the padlocks may be somewhat protected, the latches that the padlocks lock could be cut or broken, thereby rendering the padlocks useless.

U.S. Pat. No. 4,742,701 issued to Scavetto discloses a trailer lock having a movable rod and a key lock mechanism disposed in a recess for locking the rod. Scavetto's trailer lock is extremely complicated and therefore expensive. Further, the padlock used in the mechanism is permanently mounted in the recess. Additionally, Scavetto's trailer lock must be manufactured into the trailer and cannot be readily used as a replacement locking mechanism (i.e., retro-fit) for an existing door lock on the vehicle.

The present invention solves the above-mentioned problems and/or disadvantages of the prior art by providing an improved locking device that is relatively simple in construction and use while at the same time providing increased protection for a padlock. The present invention is adaptable to be used as a replacement for an existing door bolt of a vehicle.

BRIEF SUMMARY OF THE INVENTION

The present invention comprises a lock well or lock housing which is mounted in a hinged or otherwise movable unit such as a van door. A securely mounted bolt having a locking aperture is inserted through an opening in a back wall of the lock housing. A padlock is received in the lock housing and the shackle of the padlock is received in the locking aperture such that the movable unit containing the lock housing cannot be opened when the padlock is in use.

The locking aperture of the bolt is specially designed to have a lock shelf, a lock clevis aperture and a clevis track. Further, the lock housing is sized so as to be only slightly larger than the size of a padlock. The padlock, therefore, when placed through the locking aperture and locked, is capable of resting in one of three distinct positions: a vertical position, an angled position, and a horizontal position.

Accordingly, it is a principle object of the present invention to provide a novel means for locking.

It is a further object of the invention to provide a protected locking assembly.

It is also an object of the invention to provide a protective well for a padlock.

It is an additional object of the invention to provide a locking mechanism for vehicle doors such as on a van or truck.

It is another object of the invention to provide a three-position padlock locking assembly.

Numerous other advantages and features of the invention will become readily apparent from the detailed description of the preferred embodiment of the invention, from the claims, and from the accompanying drawings, in which like numerals are employed to designate like parts throughout the same.

BRIEF DESCRIPTION OF THE DRAWINGS

A fuller understanding of the foregoing may be had by reference to the accompanying drawings, wherein.

DETAILED DESCRIPTION OF THE PREFERRED EMBODIMENT OF THE PRESENT INVENTION

Figures 1, 2:
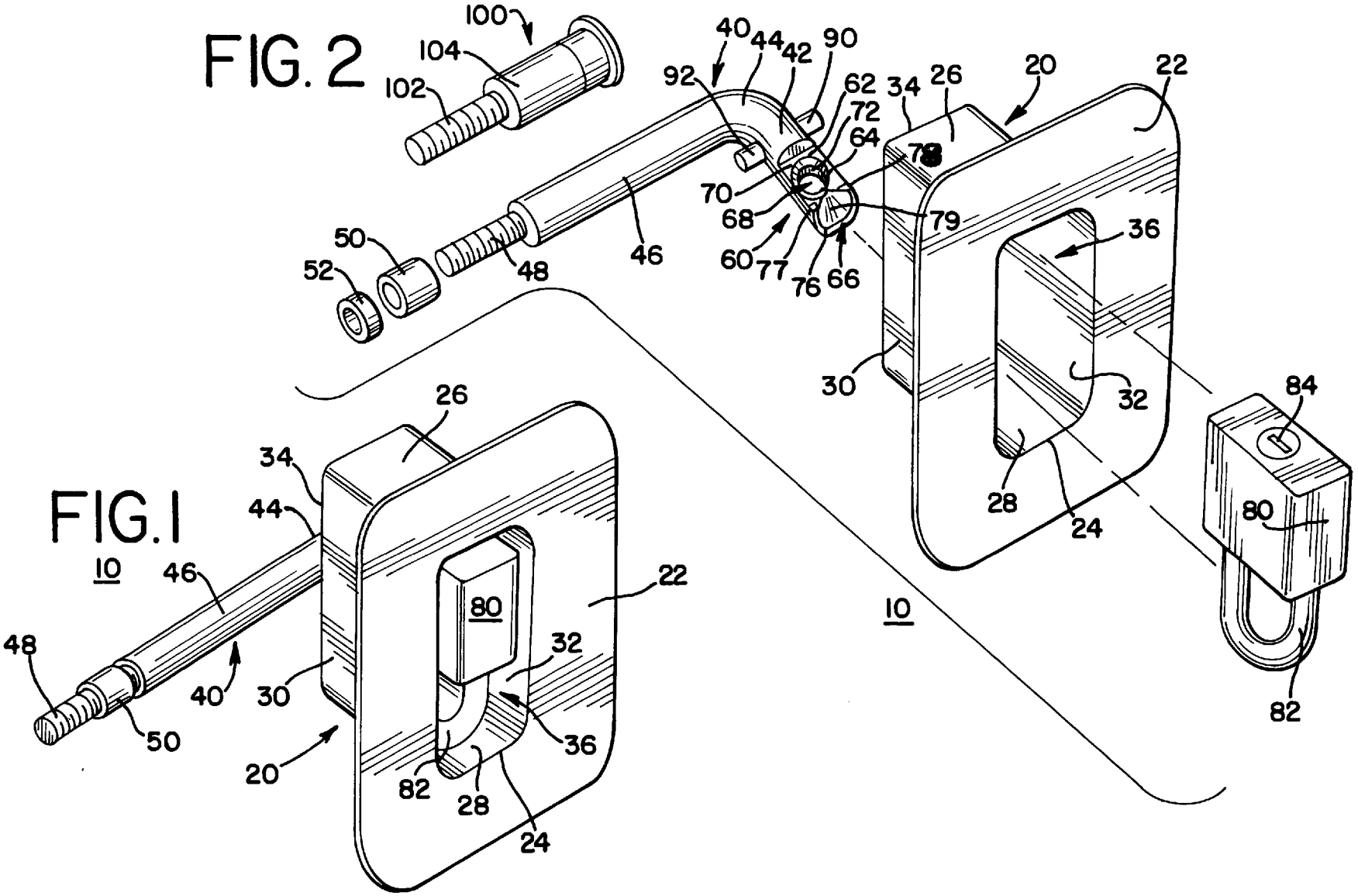
FIG. 1 is a perspective view of the preferred embodiment of the present invention.
FIG. 2 is an exploded perspective view of the present invention of FIG. 1.

While the invention is susceptible of embodiment in many different forms, there is shown in the drawings and will be described herein in detail, a preferred embodiment of the invention. It should be understood, however, that the present disclosure is to be considered an exemplification of the principles of the invention and is not intended to limit the spirit and scope of the invention and/or claims of the embodiment illustrated.

FIGS. 1–7 illustrate the present invention 10 comprising a lock well or lock housing 20, an angled bolt 40 having a locking aperture 60, and a padlock 80.

Referring now to FIG. 1, invention 10 is shown in its fully locked vertical position. Lock housing 20 is shown being substantially box-like and having a mounting flange 22 around a front perimeter of a front opening 24. Housing 20 further comprises a top wall 26, a bottom wall 28, a first sidewall 30, a second sidewall 32 and a back wall 34. Top wall 26, bottom wall 28, sidewalls 30 and 32, and back wall 34 define a padlock receiving cavity 36.

An angled bolt 40 is shown inserted through a hole 38 (not shown) in back wall 34. Angled bolt 40 comprises a first portion 42 (not shown) having locking aperture 60 (not shown) disposed in an end thereof, a bend 44, and a second portion 46 having a threaded portion 48 at an end thereof. Threaded portion 48 receives nylon bushing 50 which serves as a door striker for the locking mechanism in a vehicle door. A plurality of shims 52 (see FIG. 2) or washers can be placed on threaded portion 48 after bushing 50 is placed thereon to properly align bushing 50 on threaded portion 48.

Cavity 36 is sized to snugly receive a padlock 80 having shackle 82 and keyhole 84 and defining a longitudinal axis from the apex of shackle 82 to keyhole 84 (see FIG. 2). Padlock 80 is shown in its locked vertical position. In this position, padlock 80 rests upside down completely inside cavity 36, thereby being shielded from the weather and from attempts to cut, break or pick the lock.

For purposes of the instant invention, the term "shackle" refers to the visible portion of the padlock shackle, i.e., the portion outside of the padlock body. Further, the shackle is U-shaped, defining a two straight legged portions connected by a curved top portion.

FIG. 2 is an exploded perspective view of the present invention 10. Lock housing 20 is shown comprising mounting flange 22, front opening 24, top wall 26, bottom wall 28, sidewalls 30, 32, back wall 34, and cavity 36. Back wall 34 has a hole 38 (not shown) disposed therein.

Angled bolt 40 is shown having first portion 42 having locking aperture 60 disposed in an end thereof, bend 44, and second portion 46 having threaded portion 48 at an end thereof. Threaded portion 48 receives bushing 50 and shim 52, if necessary.

Locking aperture 60 is shown on an end of bolt portion 42. Locking aperture 60 comprises a lock shelf 62, a lock clevis aperture 64 and a clevis track 66. Lock shelf 62 is a flat planar surface cut into bolt 40 upon which padlock 80 can rest on or slightly above, depending on the size of the padlock. Lock clevis aperture 64 is defined by a slightly oval bore 68 having top circularly slanted sidewalls 70 angled downward and inward towards a midsection 72 of bore 68. Bore 68 further has bottom circularly slanted sidewalls 74 (not shown) angled upward and inward towards midsection 72. The oval shaped bore 68 and circularly slanted sidewalls facilitate the selective rotation of shackle 82 of padlock 80 to any one of the three padlock positions (as will be described later). Clevis track 66 is defined as a substantially U-shaped end 76 having two teeth 77, 78 extending above locking shelf 62. Clevis track 66 is further defined by a generally V-shaped groove 79 angled upward toward locking shelf 62 and bore 68. Angled bolt 40 further includes a roll pin 90 illustrated as a cylindrical tube mounted in a bore 92 in first portion 42 of angled bolt 40, positioned directly behind locking aperture 60. Roll pin 90 hits back wall 34 of housing 20 to prevent attempted deforming of the housing 20 to prevent access to the padlock by pulling bolt 40 forward and thus padlock 80 out of housing 20 to a position where it could be cut.

An existing door bolt 100 having threaded end 102 and bushing 104 is also shown along with present invention 10 in FIG. 2. The preferred embodiment of the present invention 10 is illustrated as a replacement or retro-fit locking mechanism for vehicles in which existing door bolt 100 is removed from the vehicle door it is mounted in and angled bolt 40 is replaced therein. Lock housing 20 is then placed into a "well" cut into the opposite vehicle door and mounted therein, such that first portion 42 of bolt 40 is received through hole 38 in back wall 34 of housing 20. As a result, when the doors of the vehicle are shut and locked and padlock 80 is inserted through locking aperture 60 and in cavity 36, the doors of the vehicle are securely double locked. The existing locking mechanism in one vehicle door locks around bushing 50 on bolt 40 mounted in the other vehicle door. Further, padlock 80 locked in housing 20 mounted in one door is securely locked to bolt 40 mounted in the other door. Should the existing locking mechanism in the vehicle door be "punched in" and thereby rendered useless, the door is still locked by bolt 40 and padlock 80.

Figure 3:
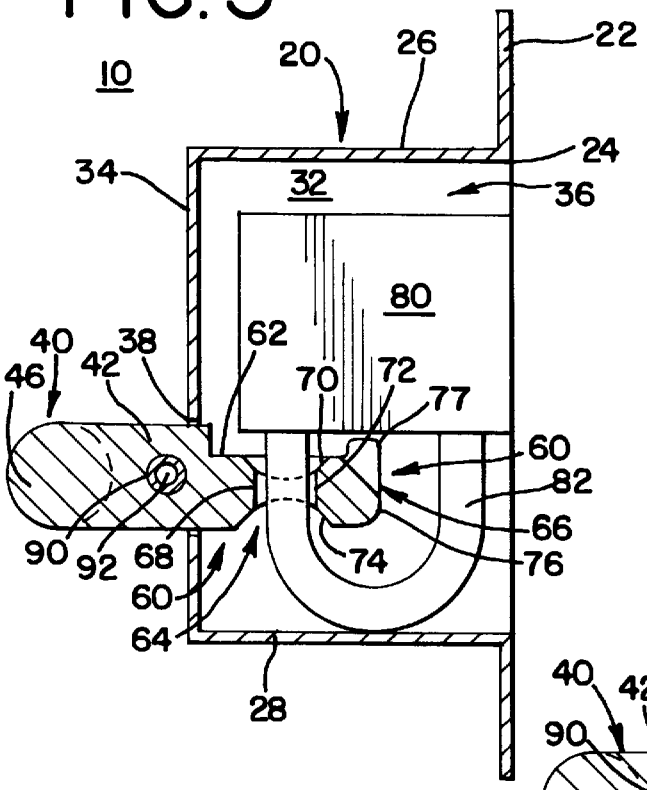
FIG. 3 is a side cross-sectional view of the present invention with a padlock in a vertical position.

FIG. 3 is a side cross-sectional view of the present invention 10 in its locked vertical position. Shackle 82 of padlock 80 is shown inserted through bore 68 of lock clevis aperture 64. The padlock is locked in its vertical position, upside down. Shackle 82 rests on bottom wall 28. Padlock 80 rests on or just above lock shelf 62. Sidewalls 30, 32 preferably just slightly touch the padlock 80 at its thickest point such that padlock is snugly yet removably nestled in cavity 36. The distance between the bottom of padlock 80 and top wall 26 is preferably just great enough for the tip of a person's index finger to be partially inserted therein. This is so that a person can pull the lock outward into its second angled position by applying a downward and outward force to the bottom edge of padlock 80.

As can be seen, padlock 80 in its vertical position is received completely inside cavity 36. Opening 24 is not large enough for a cutting tool to be inserted therein preventing the shackle 82 of padlock 80 from being quickly and easily cut. Further, keyhole 84 is protected by top wall 26 so that it cannot be readily and quickly accessed by a would-be thief. Further, a thief who has never encountered the present invention would not know how to re-position the padlock.

Figure 4:
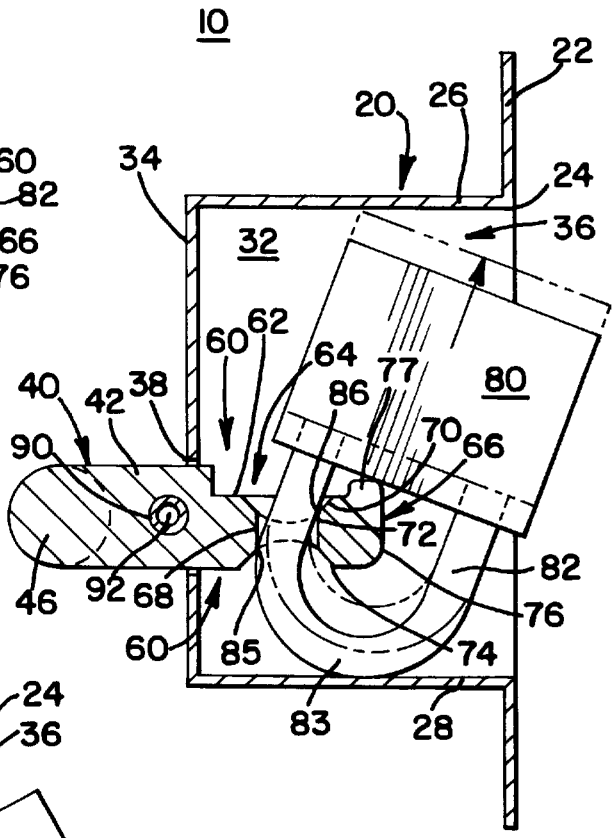
FIG. 4 is a side cross-sectional view of the present invention with a padlock in an angled position.

By applying a downward and outward force with the tip of a finger or other object to the bottom edge of padlock 80 in its vertical position, padlock 80 can be moved into its angled position as shown in FIG. 4. Shackle 82 rotates in bore 68 of lock clevis 64 until an inner edge of shackle 82 abuts sidewall 70 and an outer edge of shackle 82 abuts sidewall 74 of bore 68. Thus, padlock 80 is prevented from rotating further and rests in its angled position as shown. Hole 38 and thus bolt 40 are positioned in back wall 34 at a proper distance from bottom wall 28 such that said edges of shackle 82 contact the sidewalls of bore 68 and are prevented from further rotation. The point of contact of the edges of shackle 82 with the sidewalls 70, 74 of bore 68 should occur at a location just before the bend 83 in shackle 82 begins. This is illustrated by contact points 85 and 86. In its angled position, keyhole 84 is still unaccessible since it has not yet cleared opening 24. Further, shackle 82 still remains completely inside cavity 36, thus being prevented from being quickly and easily cut.

In order to free padlock 80 and allow it to be rotated to its horizontal position, padlock 80 must be lifted in the direction of the arrow in FIG. 4 to a position shown in phantom. Once padlock 80 is lifted, curved portion 83 of shackle 82 is now inside bore 68. Contact points 85 and 86 no longer abut sidewalls 70, 74 and the padlock is now free to be rotated to its horizontal position. Again, a thief who has never encountered the present invention would not know how to reposition the padlock. Further, any extra time a thief must spend attempting to break or pick the lock increases the chance the thief will be caught.

Figure 5:
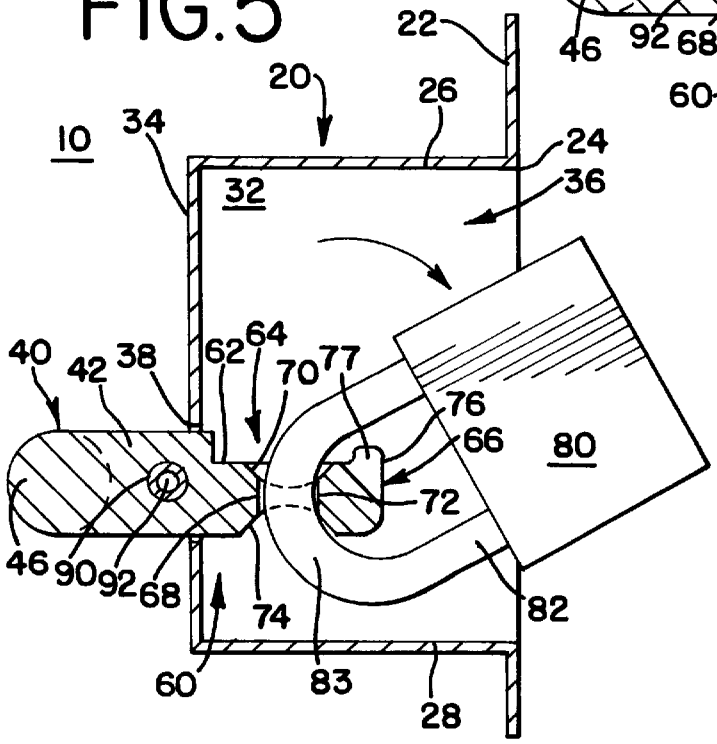
FIG. 5 is a side perspective view of the present invention with a padlock being moved to a horizontal position.

FIG. 5 illustrates the padlock 80 being rotated in the direction of the arrow to its horizontal position, after it has been lifted from its angled position. As can be seen, curved portion 83 of shackle 82 is free to rotate in bore 68 due to the design of circularly slanted sidewalls 70, 74. Once in its horizontal position, keyhole 84 is completely accessible to unlock padlock 80. However, shackle 82 remains completely inside cavity 36 and thus cannot be easily or quickly cut or broken.

Figure 6:
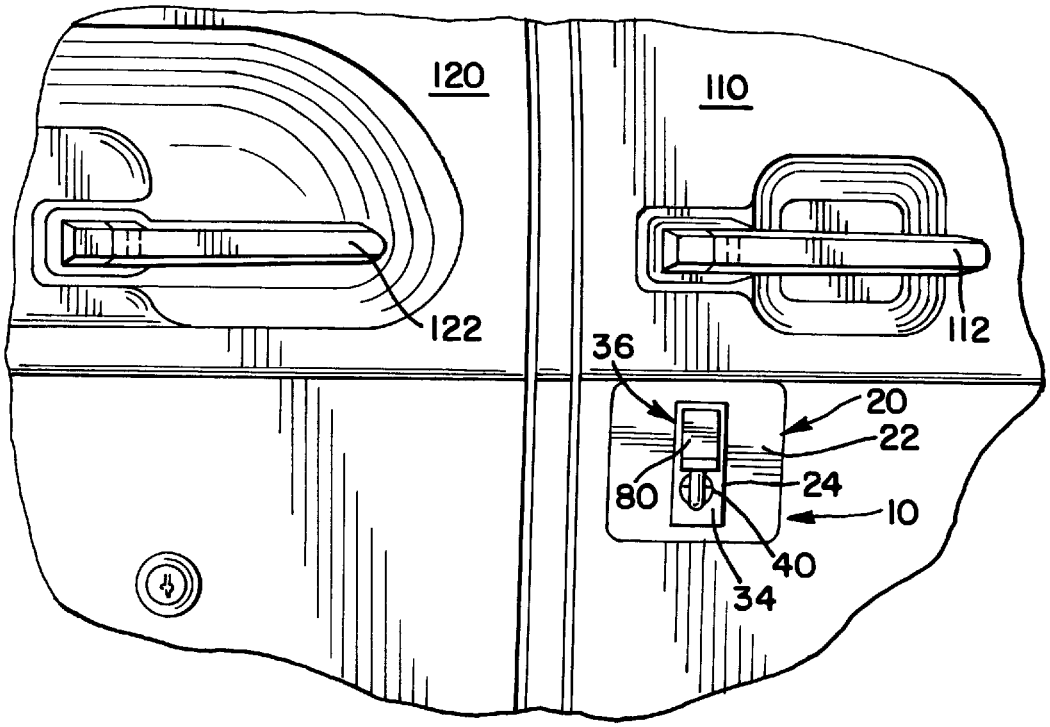
FIG. 6 is a front view of the present invention in use locking double doors of a vehicle.

FIG. 6 illustrates invention 10 in use in the double doors 110, 120 of a vehicle. Lock housing 20 is mounted in vehicle door 110 inside which the existing locking mechanism sits. Lock housing 20 is seen having mounting flange 22 (suitably mounted to door 110), front opening 24, back wall 34 and padlock receiving cavity 36. FIG. 6 depicts the doors 110, 120 in a locked position in which angled bolt 40 has passed through hole 38 (not shown) in back wall 34. Padlock 80 is locked around bolt 40 inside cavity 36, thereby preventing door 110 from opening via handle 112, even when the existing locking mechanism is unlocked. Door 120, with handle 122, in which angled bolt 40 is mounted in place of existing door bolt 100 (not shown), cannot be opened until door 110 is first opened.

Figure 7:
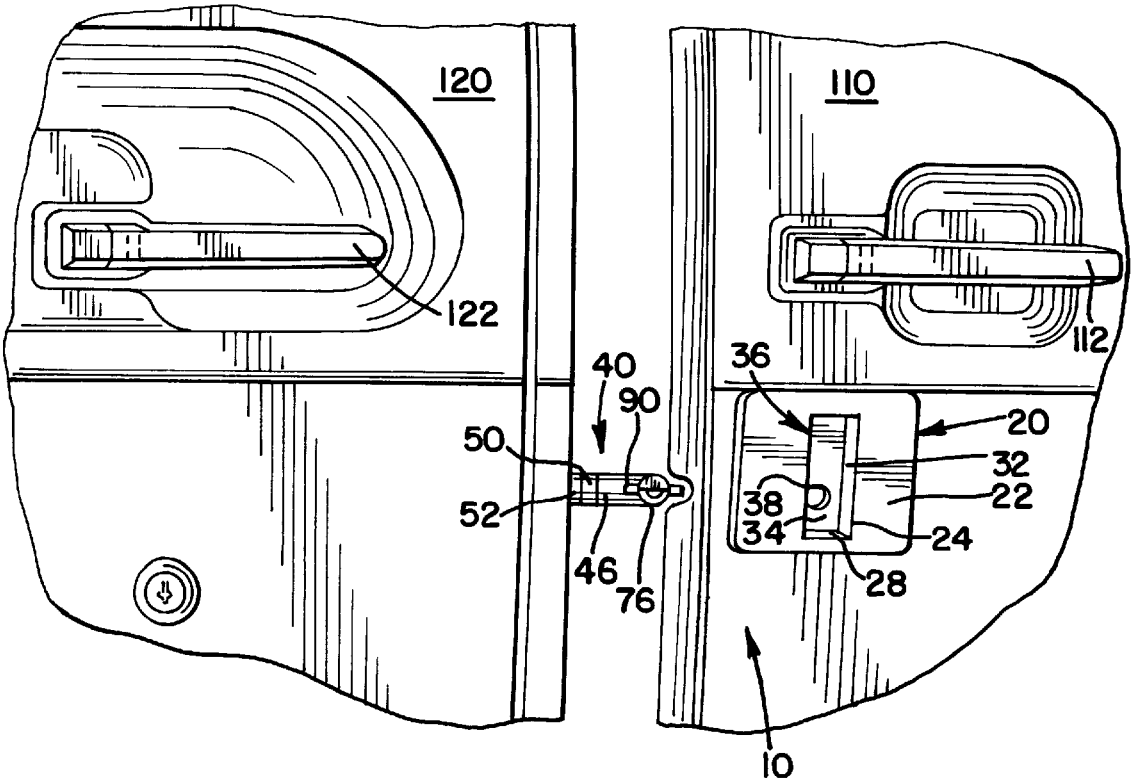
FIG. 7 is a front view of the present invention in use in a vehicle with the vehicle door unlocked and partially opened.

FIG. 7 illustrates invention 10 in use in the double doors 110, 120 of a vehicle, but in an unlocked position with door 110 partially opened. Lock housing 20 having mounting flange 22, front opening 24, bottom wall 28, sidewall 32, back wall 34, cavity 36 and hole 38, is mounted in door 110. Door 110 includes handle 112 and existing locking mechanism 130. Angled bolt 40 is shown mounted in door 120, having handle 122, in place of existing door bolt 100 (not shown). Angled bolt includes second portion 46, U-shaped end 76 and roll pin 90. Bushing 50 and shim 52 have been placed over threaded portion 48 (not shown).

To unlock the doors of a vehicle utilizing the present invention 10, the padlock is positioned from its vertical position to its angled position and then to its horizontal position. The padlock 80 is then unlocked with a key in keyhole 84 and shackle 82 is removed from locking aperture 60. The existing locking mechanism on the vehicle door is unlocked from its position around bushing 50 and the door having the well housing is then free to be opened. Then, the door having angled bolt 40 mounted therein is free to be opened.

To lock the doors, the door having angled bolt 40 is first shut, followed by the door with locking housing 20 mounted therein. First portion 42 of angled bolt 40 is received through hole 38 in back wall 34 of housing 20. The existing locking mechanism is then locked around bushing 50. Shackle 82 of padlock 80 is then inserted through lock clevis aperture 64 and padlock 80 is locked. Padlock 80 is then rotated from its horizontal position through its angled position and to its vertical position, completely inside cavity 36. Thus, the vehicle doors are securely double locked, and a would-be thief most likely would pass up the vehicle in search of an easier target.

Housing 20 is preferably made of a rigid metal that is difficult to deform. Further, housing 20 and angled bolt 40 can be sized to accommodate any size padlock. Mounting flange 22 can be any suitable size or shape and could have mounting bores therein to receive mounting bolts or the like. The present invention could be sold as a kit to modify existing vehicle doors or it could be manufactured as original equipment on a vehicle.

Further, it is foreseen that the present invention could be used to lock or double lock any type of hinged unit or enclosure, such as a locker, a garage door, a desk drawer, etc. Still further it is foreseen that the present invention could be modified for any type of use. For example, a straight bolt having a locking aperture could be used to lock a sliding door. The housing 20 would be mounted in the sliding door and the straight bolt would enter the housing 20 through a hole in a sidewall. The bolt would be mounted to any suitable fixture such as a door frame.

It is to be understood that the embodiments herein described are merely illustrative of the principles of the present invention. Various modifications may be made by those skilled in the art without departing from the spirit or scope of the claims which follow.

I claim:

1. A locking mechanism for use in conjunction with a padlock having a shackle and a keyhole, said shackle being U-shaped and defining a straight leg portion and a curved portion, said locking mechanism comprising:

means for selectively housing and protecting a locked padlock and limiting access to said keyhole, said means for selectively housing and protecting being mounted in a movable structure; and means for receiving a shackle of said padlock, said means for receiving being mounted in a fixture, said means for receiving and said means for selectively housing and protecting cooperatively associating to lock said movable structure to said fixture when said means for receiving receives said shackle of said padlock, said means for receiving having two contact areas for contacting said straight leg portion of said shackle, said keyhole being inaccessible by an authorized key within said means for selectively housing and protecting until said straight leg portion of said shackle is displaced from said two contact areas.

2. The locking mechanism of claim 1, wherein said means for selectively housing and protecting is a lock well defining a cavity for selectively receiving said locked padlock in a first position such that said locked padlock is completely within said cavity and said keyhole is protected from tampering.

3. The locking mechanism of claim 2, wherein said lock well includes a top wall, two sidewalls, a bottom wall, a back wall, a front opening and a mounting flange surrounding said front opening.

4. The locking mechanism of claim 3, wherein said back wall has a hole for receiving said means for receiving therethrough.

5. The locking mechanism of claim 1, wherein said means for receiving is a bolt having an aperture therein at an end thereof.

6. The locking mechanism of claim 5, wherein said means for selectively housing and protecting has a back wall, said back wall having a hole, said end of said bolt selectively receivable into said means for selectively housing and protecting through said hole.

7. The locking mechanism of claim 6, wherein said bolt has a means for limiting travel into said means for selectively housing and protecting.

8. The locking mechanism of claim 7, wherein said means for limiting is a roll pin which abuts said back wall of said means for selectively housing and protecting.

9. The locking mechanism of claim 5, wherein said aperture includes a lock shelf, a lock clevis aperture, and a clevis track.

10. The locking mechanism of claim 9, wherein said lock clevis aperture is a bore having a midsection, top sidewalls downwardly and inwardly angled toward said midsection and bottom sidewalls upwardly and inwardly angled toward said midsection.

11. The locking mechanism of claim 9, wherein said clevis track is a generally U-shaped end having two upwardly projecting teeth and an upwardly angled, generally V-shaped groove between said teeth.

12. The locking mechanism of claim 1, wherein said locked padlock is selectively positionable in said means for selectively housing and protecting in one of three locked positions, defining a first locked position, a second locked position, and a third locked position.

13. The locking mechanism of claim 12, wherein said padlock defines a longitudinal axis, said first locked position is an upside down, vertical position wherein said longitudinal axis is perpendicular to a bottom wall of said means for selectively housing and protecting and said shackle is adjacent said bottom wall, and said padlock is completely inside said means for selectively housing and protecting and said keyhole is inaccessible, said means for receiving receives said straight leg portion of said shackle.

14. The locking mechanism of claim 13, wherein said second locked position is an angled position wherein said longitudinal axis is at an angle to said bottom wall of said means for selectively housing and protecting and said keyhole is inaccessible, said two contact areas contact said straight leg portion of said shackle.

15. The locking mechanism of claim 14, wherein said third locked position is a horizontal position wherein said longitudinal axis is parallel to a bottom wall of said means for selectively housing and protecting and said shackle of said padlock remains completely inside said means for selectively housing and protecting and said keyhole is accessible, said means for receiving receives said curved portion of said shackle.

16. The locking mechanism of claim 15, wherein said straight leg portion of said shackle must be displaced away from said bottom wall and out of said means for receiving to be moved from said angled position to said horizontal position to gain access to said keyhole.

17. The locking mechanism of claim 5, wherein said bolt is an angled bolt having a first portion, a bend, and a second portion.

18. A locking mechanism for use in conjunction with a padlock having a shackle, said locking mechanism comprising:

means for housing a padlock, said means for housing being mounted in a movable structure; and a bolt for receiving a shackle of a padlock and having an aperture therein at an end thereof, said bolt being an angled bolt having a first portion, a bend, and a second portion, said aperture is in said first portion, said second portion having a threaded end, said bolt being mounted in a fixture, said bolt and said means for housing cooperatively associating to lock said movable structure to said fixture when said bolt receives said shackle of said padlock.

19. The locking mechanism of claim 18, wherein said movable structure is a hinged vehicle door having an existing locking mechanism, and said fixture is a complementary hinged vehicle door having said bolt mounted therein.

20. The locking mechanism of claim 19, wherein said threaded end receives a bushing, said existing locking mechanism capable of locking around said bushing.

21. A protected locking mechanism used in conjunction with a padlock to lock hinged, double vehicle doors, said locking mechanism comprising:

a housing defining a cavity and having a top wall, two side walls, a bottom wall, a back wall having a hole, a front opening and a mounting flange surrounding said front opening;

an angled bolt having a first portion, a bend and a second portion; and a locking aperture in said first portion, said locking aperture having a lock shelf, a lock clevis aperture, and a clevis track;

said housing mounted in one vehicle door, said bolt mounted in a complementary vehicle door such that said housing receives said first portion of said angled bolt through said hole in said back wall when said doors are in a closed position, a shackle of said padlock receivable through said locking aperture to lock said padlock to said bolt, in said housing, to lock said vehicle door.

22. The locking mechanism of claim 21, wherein said bolt has a limit member which abuts said back wall of said housing to limit travel of said first portion of said bolt into said housing through said hole in said back wall of said housing.

23. The locking mechanism of claim 21, wherein said lock clevis aperture is a bore having a midsection, top sidewalls downwardly and inwardly angled toward said midsection and bottom sidewalls upwardly and inwardly angled toward said midsection.

24. The locking mechanism of claim 21, wherein said clevis track is a generally U-shaped end having two upwardly projecting teeth and an upwardly angled, generally V-shaped groove between said teeth.

25. The locking mechanism of claim 21, wherein said padlock is selectively movable in said cavity of said housing between a vertical position, an angled position and a horizontal position.

26. The locking mechanism of claim 25, wherein said padlock must be lifted to be moved from said angled position to said horizontal position.

27. The locking mechanism of claim 21, wherein said second portion of said bolt has a threaded portion, said threaded portion receiving a bushing, said one vehicle door having an existing locking mechanism for locking around said bushing.

28. A method of double locking hinged double doors of a vehicle having an existing locking mechanism which locks around an existing lock bolt, comprising the steps of:

mounting a lock housing in a well cut into a vehicle door having said existing locking mechanism, said lock housing including a back wall having a hole;

removing an existing lock bolt from a complementary vehicle door;

replacing said existing lock bolt with an angled bolt, said angled bolt having a first portion, a bend, and a second portion, said first portion having a locking aperture, said second portion having a threaded end;

placing a bushing on said threaded end of said second portion, said bushing selectively receiving said existing locking mechanism;

passing said first portion of said bolt through said hole in said back wall of said housing;

inserting a shackle of a padlock through said aperture of said first portion of said bolt in said housing;

locking said padlock; and positioning said padlock in said housing.

29. A locking mechanism for use in conjunction with a padlock having a shackle and a keyhole, said shackle being U-shaped and defining a straight leg portion and a curved portion, said locking mechanism comprising:

a generally rectangular box-like padlock housing comprising a bottom wall and a front opening and defining a cavity, said cavity selectively receiving said padlock substantially entirely therein and limiting access to said keyhole;

means for receiving a shackle of a padlock, said means for receiving selectively positioned inside said cavity of said housing, said padlock being lockable thereto with said straight leg portion resting in said means for receiving in a first position; and means in said means for receiving for preventing said locked padlock from being positioned outside said cavity to a point where said keyhole is accessible by an authorized key, until displacement of said straight leg portion of said shackle out from said means for receiving.

30. A locking mechanism for use in conjunction with a padlock having a shackle and a keyhole, said shackle being U-shaped and defining a straight leg portion and a curved top portion, said locking mechanism comprising:

a generally rectangular box-like padlock housing comprising a bottom wall and a front opening and defining a cavity;

a shackle receiving element positioned within said cavity, said cavity selectively receiving said padlock substantially entirely therein and limiting access to said keyhole in a first position, said straight leg portion of said shackle resting in said shackle receiving element while in said first position; and said shackle receiving element having at least two contact areas for preventing said padlock from being positioned outside said cavity to a point where said keyhole is readily accessible, said at least two contact areas contacting said straight leg portion of said shackle in a second position, said at least two contact areas preventing movement of said padlock to a third position where the keyhole is accessible, until said shackle is displaced within said shackle receiving element such that said straight leg portion is removed from said shackle receiving element and said curved top portion is positioned within said shackle receiving element.

* * * * *